US007169017B1

(12) United States Patent
Saikin

(10) Patent No.: US 7,169,017 B1
(45) Date of Patent: Jan. 30, 2007

(54) POLISHING PAD HAVING A WINDOW WITH REDUCED SURFACE ROUGHNESS

(75) Inventor: Alan H. Saikin, Landenberg, PA (US)

(73) Assignee: Rohm and Haas Electronic Materials CMP Holdings, Inc., Newark, DE (US)

( * ) Notice: Subject to any disclaimer, the term of this patent is extended or adjusted under 35 U.S.C. 154(b) by 0 days.

(21) Appl. No.: 11/492,443

(22) Filed: Jul. 25, 2006

Related U.S. Application Data

(60) Provisional application No. 60/706,971, filed on Aug. 10, 2005.

(51) Int. Cl.
*B24B 49/00* (2006.01)
*B24B 1/00* (2006.01)
*B24D 11/00* (2006.01)

(52) U.S. Cl. ..... 451/6; 451/56; 451/528

(58) Field of Classification Search ..... 451/6, 451/41, 56, 527, 528, 539
See application file for complete search history.

(56) References Cited

U.S. PATENT DOCUMENTS

| | | | | |
|---|---|---|---|---|
| 5,246,782 | A * | 9/1993 | Kennedy et al. | 428/421 |
| 6,280,290 | B1 | 8/2001 | Birang et al. | |
| 6,866,559 | B2 * | 3/2005 | Lehman et al. | 451/8 |
| 6,884,146 | B2 * | 4/2005 | Lehman et al. | 451/5 |
| 6,935,922 | B2 * | 8/2005 | Lehman et al. | 451/5 |
| 7,030,018 | B2 * | 4/2006 | Lehman et al. | 438/692 |
| 2003/0181131 | A1 * | 9/2003 | Lehman et al. | 451/5 |

* cited by examiner

*Primary Examiner*—M. Rachuba
(74) *Attorney, Agent, or Firm*—Edwin Oh

(57) ABSTRACT

The present invention provides a polishing pad for performing chemical mechanical planarization of semiconductor substrates. The polishing pad comprises a polishing pad body having an aperture formed therein and a window fixed in the aperture for performing in-situ optical measurements of the substrate. The window has a lower surface capable of transmitting light incident thereon. The lower surface has been treated by laser ablation to remove surface roughness present on the lower surface.

4 Claims, 4 Drawing Sheets

POLISHING PAD HAVING A WINDOW WITH REDUCED SURFACE ROUGHNESS

CROSS REFERENCE TO RELATED APPLICATION

This application claims the benefit of U.S. Provisional Application Ser. No. 60/706,971 filed Aug. 10, 2005.

FIELD OF THE INVENTION

The present invention relates to polishing pads used for chemical-mechanical planarization (CMP), and in particular relates to such pads that have windows formed therein for performing optical end-point detection.

BACKGROUND OF THE INVENTION

In the fabrication of integrated circuits and other electronic devices, multiple layers of conducting, semiconducting, and dielectric materials are deposited on or removed from a surface of a semiconductor wafer. Thin layers of conducting, semiconducting, and dielectric materials may be deposited by a number of deposition techniques. Common deposition techniques in modern processing include physical vapor deposition (PVD), also known as sputtering, chemical vapor deposition (CVD), plasma-enhanced chemical vapor deposition (PECVD), and electrochemical plating (ECP).

As layers of materials are sequentially deposited and removed, the uppermost surface of the substrate may become non-planar across its surface and require planarization. Planarizing a surface, or "polishing" a surface, is a process where material is removed from the surface of the wafer to form a generally even, planar surface. Planarization is useful in removing undesired surface topography and surface defects, such as rough surfaces, agglomerated materials, crystal lattice damage, scratches, and contaminated layers or materials. Planarization is also useful in forming features on a substrate by removing excess deposited material used to fill the features and to provide an even surface for subsequent levels of metallization and processing.

Chemical mechanical planarization, or chemical mechanical polishing (CMP), is a common technique used to planarize substrates such as semiconductor wafers. In conventional CMP, a wafer carrier or polishing head is mounted on a carrier assembly and positioned in contact with a polishing pad in a CMP apparatus. The carrier assembly provides a controllable pressure to the substrate urging the wafer against the polishing pad. The pad is moved (e.g., rotated) relative to the substrate by an external driving force. Simultaneously therewith, a chemical composition ("slurry") or other fluid medium is flowed onto the substrate and between the wafer and the polishing pad. The wafer surface is thus polished by the chemical and mechanical action of the pad surface and slurry in a manner that selectively removes material from the substrate surface.

A problem encountered when planarizing a wafer is knowing when to terminate the process. To this end, a variety of planarization end-point detection schemes have been developed. One such scheme involves optical in-situ measurements of the wafer surface. The optical technique involves providing the polishing pad with a window transparent to select wavelengths of light. A light beam is directed through the window to the wafer surface, where it reflects and passes back through the window to a detector, e.g., an interferometer. Based on the return signal, properties of the wafer surface, e.g., the thickness of films (e.g., oxide layers) thereon, can be determined.

While many types of materials for polishing pad windows can be used, in practice the windows are typically made of the same material as the polishing pad, e.g., polyurethane. For example, U.S. Pat. No. 6,280,290 discloses a polishing pad having a window in the form of a polyurethane plug. The pad has an aperture and the window is held in the aperture with adhesives.

A problem with such windows arises when they have surface roughness. For example, polyurethane windows are typically formed by slicing a section from a polyurethane block. Unfortunately, the slicing process produces surface imperfections or roughness R on either side of the window 1 in polishing pad 10, as shown in FIG. 1. The depth of the roughness ranges from about 10 to about 100 microns. The roughness on the bottom surface scatter the light used to measure the wafer surface topography, thereby reducing the signal strength of the in-situ optical measurement system. The roughness on the upper surface do not tend to scatter light as much as the bottom surface roughness due to the presence of a liquid slurry and proximity of the upper surface to the wafer.

Because of the loss in signal strength from scattering by the lower window surface, the measurement resolution suffers, and measurement variability is a problem. Accordingly, what is needed a polishing pad for chemical-mechanical planarization with an improved window having greater light transmission and less light scattering properties.

SUMMARY OF THE INVENTION

In one aspect of the invention, there is provided a polishing pad for performing chemical mechanical planarization of semiconductor substrates, the polishing pad comprising: a polishing pad body having an aperture formed therein; a window fixed in the aperture for performing in-situ optical measurements of the substrate, the window having a lower surface capable of receiving light incident thereon; and wherein the lower surface has been treated by laser ablation to remove surface roughness present on the lower surface.

In another aspect of the invention, there is provided a polishing pad useful for chemical mechanical planarization, the polishing pad comprising: a polishing pad body having a window fixed therein for performing in-situ optical measurements of a substrate, the window having a lower surface capable of transmitting light incident thereon; wherein the lower surface has been treated by laser ablation to remove surface roughness present on the lower surface; and wherein the lower surface further comprises micro-lenses formed by the laser ablation.

In another aspect of the invention, there is provided a polishing pad useful for chemical mechanical planarization, the polishing pad comprising: a polishing pad body having a window fixed therein for performing in-situ optical measurements of a substrate, the window having a lower surface capable of transmitting light incident thereon; and wherein the lower surface has been treated by laser ablation to form micro-lenses.

In another aspect of the invention, there is provided a method of forming a polishing pad for chemical mechanical planarization of semiconductor substrates, the polishing pad comprising: providing a polishing pad body having an aperture formed therein; fixing a window in the aperture for performing in-situ optical measurements of the substrate, the window having a lower surface capable of receiving light incident thereon; and treating the lower surface by laser ablation to remove surface roughness present on the lower surface.

In another aspect of the invention, there is provided a method of performing in-situ optical measurements of a substrate in a chemical-mechanical planarization (CMP) system, comprising: providing the CMP system with a polishing pad having a window, the window having a lower surface treated by laser ablation to remove surface roughness present on the lower surface; directing a first beam of light through the laser-ablation treated surface and the window to the substrate; and reflecting the first beam of light from the substrate to form a second beam of light that passes back through the window and the laser-ablation treated surface.

DETAILED DESCRIPTION OF THE INVENTION

In the following detailed description of the embodiments of the invention, reference is made to the accompanying drawings that form a part hereof, and in which is shown by way of illustration specific embodiments in which the invention may be practiced. These embodiments are described in sufficient detail to enable those skilled in the art to practice the invention, and it is to be understood that other embodiments may be utilized and that changes may be made without departing from the scope of the present invention. The following detailed description is, therefore, not to be taken in a limiting sense, and the scope of the present invention is defined only by the appended claims.

Figure 2:
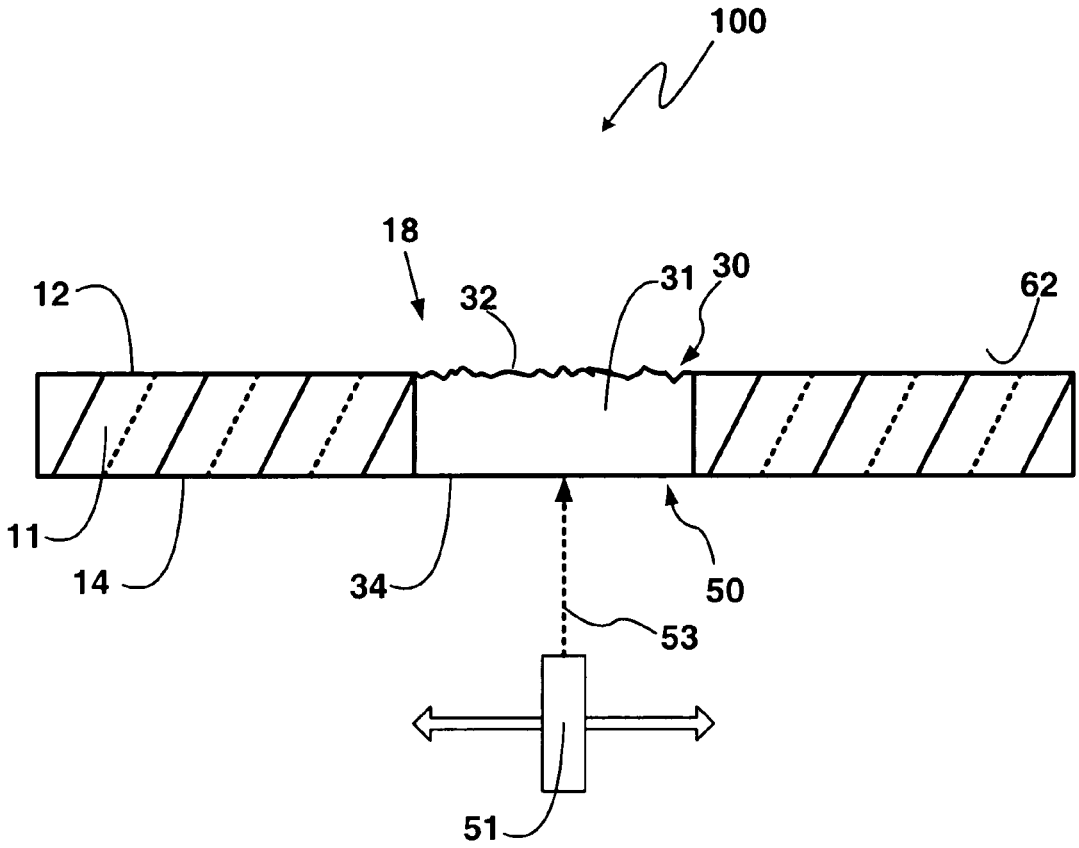
FIG. 2 illustrates a cross-sectional view of an embodiment of the window of the present invention having reduced surface roughness.

Referring to the drawings, FIG. 2 illustrates a close-up cross-sectional view of a polishing pad 100. Polishing pad 100 has a body region 11 that includes an upper surface 12 and a lower surface 14. Polishing pad 100 may be any of the known polishing pads, such as urethane-impregnated felts, microporous urethane pads of the type sold under the tradename POLITEX by Rohm and Haas Electronic Materials CMP Inc. ("RHEM"), of Newark, Del., or filled and/or blown composite urethanes such as the IC-Series and MH-series pads, also manufactured by RHEM.

Polishing pad 100 also includes an aperture 18 in body 11 with a window 30 fixed therein. In one example embodiment, window 30 is permanently fixed ("integral window") in the aperture, while in another example embodiment it is removably fixed in the aperture. Window 30 has a body region 31 that includes an upper surface 32 and a lower surface 34. Window 30 is transparent to wavelengths of light used to perform optical in-situ measurements of a substrate (e.g., wafer W) during planarization. Example wavelengths range between 190 to 3500 nanometers.

Window 30 is made of any material (e.g., polymers such as polyurethane, acrylic, polycarbonate, nylon, polyester, etc.) that might have roughness R (in FIG. 1) on one or more of its surfaces. Roughness R is capable of scattering significant amounts (e.g., 10% or more) of the light incident thereon when performing in-situ end-point measurements.

As discussed above, roughness R arises from an instrument (not shown) used to form the window by cutting it from a larger block of window material. However, roughness R can arise from any number of other sources, such as inherent material roughness, not polishing the window material, improperly polishing the window material, etc.

Figure 1:
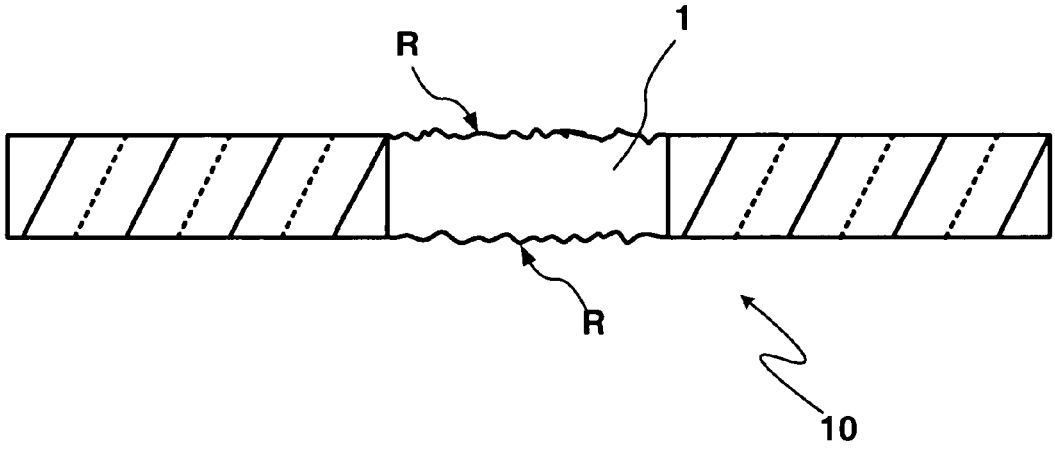
FIG. 1 illustrates a conventional polishing pad with a window having a surface roughness.

With continuing reference to FIG. 2, in an exemplary embodiment of the present invention, window 30 includes a laser-ablation treated surface 50 on lower surface 34. In other words, lower surface 34 is treated with a laser beam 53 from a laser 51 to remove the surface roughness present on the lower surface 34, for example, after the above-noted cutting process. Hence, the roughness R present in FIG. 1 is reduced by micro-machining the surface roughness R down to a relatively flat lower surface 34. In this way, a greater amount of light is transmitted through the window 30, allowing for a more robust end-point detection signal and greater precision and accuracy during the delicate chemical-mechanical planarization process. Also, the output intensity of the laser may be reduced due to the greater transmission properties of the window 30, extending the life of the laser. Note, the upper surface 32 may also be treated by laser-ablation to further enhance the light transmission properties of the window 30.

Note, laser 51 can be moved in any direction (i.e., x, y or z plane) to accommodate numerous designs or configurations as desired. In the present invention, any supporting member (not shown), for example, a table to support the polishing pad, need not be moved relative to the laser 51. Rather, laser 51 can be moved to achieve, for example, the desired removal of surface roughness R, independent of any movement of the supporting member. In addition, an inert gas may be provided from a nozzle (not shown) to reduce oxygen at the cutting surface, reducing burns or chars on the cutting surface edge. Also, the laser beam may be utilized in conjunction with a high pressure waterjet to reduce the heat that may be produced by conventional laser cutting processes.

In the present embodiment, the laser 51 used for micro-machining may be pulsed excimer lasers that have a relatively low duty cycle. Optionally, laser 51 may be a continuous laser that is shuttered (i.e., the pulse width (time) is very short compared to the time between pulses). Example lasers are MicroAblator™ from Exitech, Inc. Note, even though excimer lasers have a low average power compared to other larger lasers, the peak power of the excimer lasers can be quite large. The peak intensity and fluence of the laser is given by:

$$\text{Intensity}(\text{Watts}/\text{cm}^2)=\text{peak power}(\text{W})/\text{focal spot area}(\text{cm}^2)$$

$$\text{Fluence}(\text{Joules}/\text{cm}^2)=\text{laser pulse energy}(\text{J})/\text{focal spot area}(\text{cm}^2)$$

while the peak power is:

$$\text{Peak power}(\text{W})=\text{pulse energy}(\text{J})/\text{pulse duration}(\text{sec})$$

During laser ablation, several key parameters should be considered. An important parameter is the selection of a wavelength with a minimum absorption depth. This should allow a high energy deposition in a small volume for rapid and complete ablation. Another parameter is short pulse duration to maximize peak power and to minimize thermal conduction to the surrounding work material. This combination will reduce the amplitude of the response. Another parameter is the pulse repetition rate. If the rate is too low, energy that was not used for ablation will leave the ablation zone allowing cooling. If the residual heat can be retained, thus limiting the time for conduction, by a rapid pulse repetition rate, the ablation will be more efficient. In addition, more of the incident energy will go toward ablation and less will be lost to the surrounding work material and the environment. Yet another important parameter is the beam quality. Beam quality is measured by the brightness (energy), the focusability, and the homogeneity. The beam energy is less useful if it can not be properly and efficiently delivered to the ablation region. Further, if the beam is not of a controlled size, the ablation region may be larger than desired with excessive slope in the sidewalls.

In addition, if the removal is by vaporization, special attention must be given to the plume. The plume will be a plasma-like substance consisting of molecular fragments, neutral particles, free electrons and ions, and chemical reaction products. The plume will be responsible for optical absorption and scattering of the incident beam and can condense on the surrounding work material and/or the beam delivery optics. Normally, the ablation site is cleared by a pressurized inert gas, such as nitrogen or argon.

Note, the lower surface 34 need not be entirely flat. For example, lower surface 34 can have slowly varying surface curvature that does not scatter light, but merely reflects light at a slight angle. This is because laser-ablation treated surface 50 is designed to eliminate light scattering, which is the main cause of signal degradation in optical in-situ monitoring systems.

Figure 3:
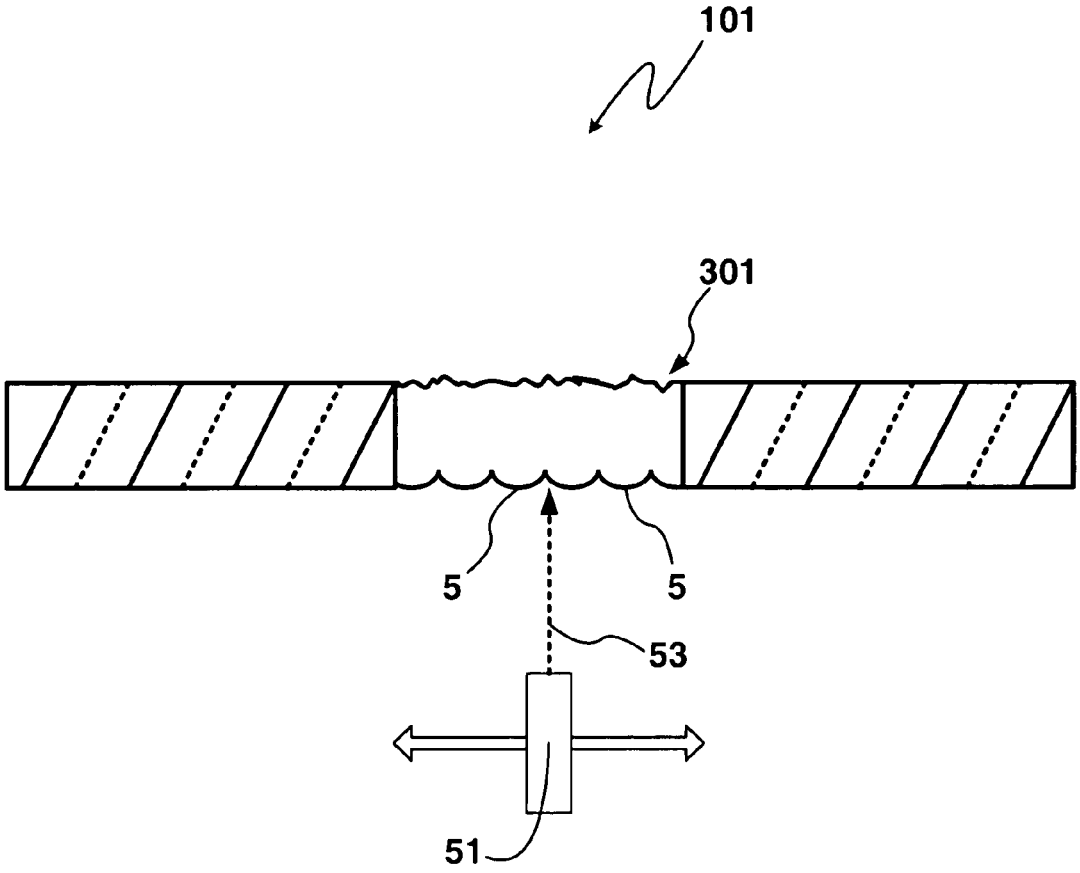
FIG. 3 illustrates a cross-sectional view of another embodiment of the window of the present invention having micro-lenses formed therein.

Referring now to FIG. 3, in another embodiment of the present invention, a window 301 is provided with an array of micro-lenses 5. The micro-lens 5 may be formed by treating the window 301 (or portions thereof) with laser ablation utilizing laser 51 as discussed above. Photo-laser ablation is preferred. Although, thermal-laser ablation may be utilized as well. These micro-lenses 5 focus and intensify the beam of light from an in-situ optical measurement system allowing for a more robust signal for better end-point detection. Micro-lenses 5 may be sized to optimize or enhance the beam of light 53 from laser 51. Preferably, micro-lenses 5 is between 5 μm to 200 μm wide. More preferably, micro-lenses 5 is between 10 μm to 100 μm wide. Optionally, the micro-lenses 5 may be formed in conjunction with the laser ablation process to remove roughness R as discussed with respect to FIG. 2. Also, as in the previous embodiment, the output intensity of the laser may be reduced due to the greater transmission properties of the window 30, extending the life of the laser.

Figure 4:
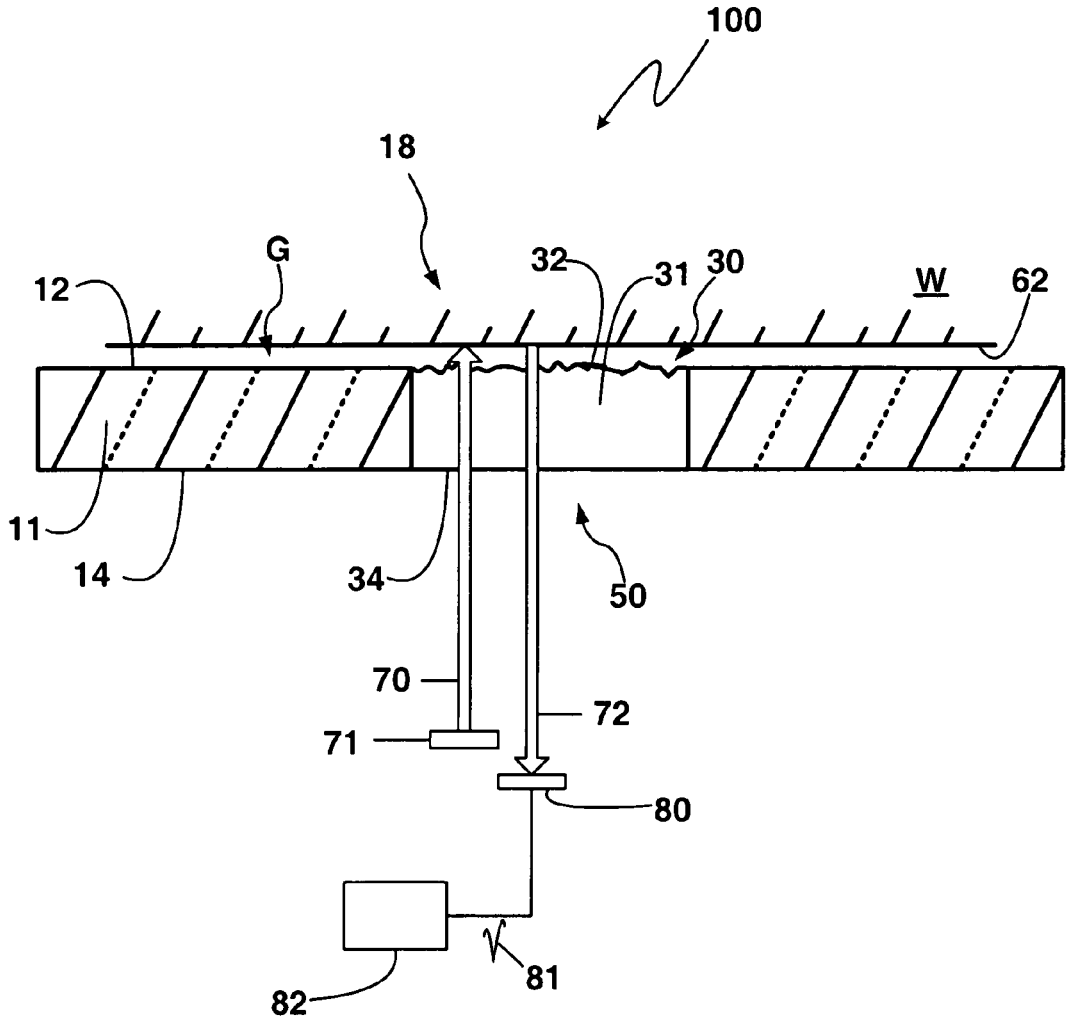
FIG. 4 illustrates a cross-sectional view of a CMP system showing a polishing pad of the present invention having a window with a laser-ablation treated surface, a wafer residing adjacent the upper surface of the polishing pad, and the basic elements of an in-situ optical detection system.

Referring now to FIG. 4, the operation of the present invention for performing in-situ optical measurements of wafer W having a surface 62 to be measured is now described. In operation, a first light beam 70 is generated by a light source 71 and is directed towards wafer surface 62. First light beam 70 has a wavelength that is transmitted by both window 30 and laser-ablation treated surface 50.

First light beam 70 reaches wafer surface 62 by passing through the laser-ablation treated surface 50, window lower surface 34, window body portion 31, window upper surface 32, and a gap G between the window upper surface 32 and the wafer surface 62. Gap G is occupied by a slurry 68 (not shown), which in practice acts as an index-matching fluid to reduce the scattering of light from roughness R (FIG. 1) on window upper surface 32. First light beam 70, or more specifically, a portion thereof reflects from wafer surface 62. Wafer surface 62 is shown schematically herein. In actuality, wafer surface 62 represents surface topography or one or more interfaces present on the wafer due to different films (e.g., oxide coatings).

The reflection of first light beam 70 from wafer surface forms a second light beam 72 that is directed back along the incident direction of first light beam 70. In an example embodiment where wafer surface 62 includes multiple interfaces due to one or more films resided thereon, reflected light beam 72 includes interference information due to multiple reflections.

Upon reflection from wafer surface 62, second light beam 72 traverses gap G (including the slurry residing therein), and passes through window upper surface 32, window body 31, window lower surface 34, and finally through the laser-ablation treated surface 50. It is noteworthy that the reflections from each interface, including those on the wafer are two-fold because of retro-reflection from wafer surface 62. In other words, the light passes twice through each interface with the exception of the actual wafer surface itself.

Upon exiting the laser-ablation treated surface 50, light beam 72 is detected by a detector 80. In an example embodiment, a beam splitter (not shown) is used to separate first and second light beams 70 and 72. Detector 80 then converts the detected light to an electrical signal 81, which is then processed by a computer 82 to extract information about the properties of wafer W, e.g., film thickness, surface planarity, surface flatness, etc.

Because window 30 includes the laser-ablation treated surface 50, light loss due to scattering from roughness R on window lower surface 34 is greatly diminished. This results in a signal strength that is greater than otherwise possible. Preferably, the second light beam 72 with the laser-ablation treated surface 50 may provide up to a 3× improvement in the signal strength.

Such improvements in signal strength lead to significant improvements in the in-situ optical measurement of wafer surface parameters. In particular, reliability and measurement accuracy are improved. Further, the pad lifetime can be extended because the stronger signals make other sources of signal loss less significant. Stated differently, the reduction in scattering from the roughness R allows the other sources of scattering, such as increased roughness of the window upper surface during polishing, and increasing amounts of debris from the planarization process, to become larger without having to replace the pad or the window.

What is claimed is:

1. A polishing pad for performing chemical mechanical planarization of semiconductor substrates, the polishing pad comprising: a polishing pad body having an aperture formed therein; a window fixed in the aperture for performing in-situ optical measurements of the substrate, the window having a lower surface capable of receiving light incident thereon; and wherein the lower surface has been treated by laser ablation to remove surface roughness present on the lower surface; and the window having micro-lenses in the lower surface, formed by the laser ablation.

2. A polishing pad useful for chemical mechanical planarization, the polishing pad comprising:

a polishing pad body having a window fixed therein for performing in-situ optical measurements of a substrate, the window having a lower surface capable of transmitting light incident thereon;

wherein the lower surface has been treated by laser ablation to remove surface roughness present on the lower surface; and wherein the lower surface further comprises micro-lenses formed by the laser ablation.

3. A polishing pad useful for chemical mechanical planarization, the polishing pad comprising:

a polishing pad body having a window fixed therein for performing in-situ optical measurements of a substrate, the window having a lower surface capable of transmitting light incident thereon; and wherein the lower surface has been treated by laser ablation to form micro-lenses.

4. A method of forming a polishing pad for chemical mechanical planarization of semiconductor substrates, the polishing pad comprising: providing a polishing pad body having an aperture formed therein; fixing a window in the aperture for performing in-situ optical measurements of the substrate, the window having a lower surface capable of receiving light incident thereon; and treating the lower surface by laser ablation to remove surface roughness present on the lower surface; wherein the lower surface has been further treated to form micro-lenses in the lower surface.

* * * * *